United States Patent [19]

Galdabini

[11] 4,306,435

[45] Dec. 22, 1981

[54] MACHINE FOR AUTOMATICALLY STRAIGHTENING-OUT ELONGATE WORKPIECES

[76] Inventor: Renzo Galdabini, Cardano al Campo, Italy

[21] Appl. No.: 58,924

[22] Filed: Jul. 19, 1979

[30] Foreign Application Priority Data

Jul. 26, 1978 [IT] Italy ..... 26137 A/78

[51] Int. Cl.[3] ..... B21D 7/12; B21D 7/00

[52] U.S. Cl. ..... 72/9; 72/389; 72/12

[58] Field of Search ..... 72/8–12, 72/389, 390, 80

[56] References Cited

U.S. PATENT DOCUMENTS

| | | | |
|---|---|---|---|
| 3,481,170 | 12/1969 | Galdabini | 72/11 |
| 3,518,868 | 7/1970 | Cargill | 72/389 |
| 3,808,660 | 5/1974 | Wik | 301/5 B |
| 3,951,563 | 4/1976 | Ravenhall | 29/159.01 |
| 4,154,073 | 5/1979 | Galdabini | 72/389 |

*Primary Examiner*—Lowell A. Larson

*Attorney, Agent, or Firm*—Cushman, Darby & Cushman

[57] ABSTRACT

A method and apparatus for straightening longitudinal curvature of a workpiece by a bending action involves supporting the workpiece between two supporting members, rotating the workpiece, engaging a plurality of sensors with the peripheral surface of the workpiece at longitudinally spaced-apart locations and generating with the sensors first periodic electric signals proportional to the apparent radius at the location of the sensors, whereby the signals are an indication of longitudinal curvature and of any deviation of the cross-sectional shape of the workpiece from a true circle, transforming the first signals into second electric signals the magnitude of which varies with the law of variation corresponding to the first harmonic of the development in Fourier's series of the first signals and the frequency of which equals the frequency of rotation of the workpiece, and applying bending forces to the workpiece in the sense of deforming the workpiece to minimize the amplitude of the second signals.

2 Claims, 5 Drawing Figures

Figure 1:
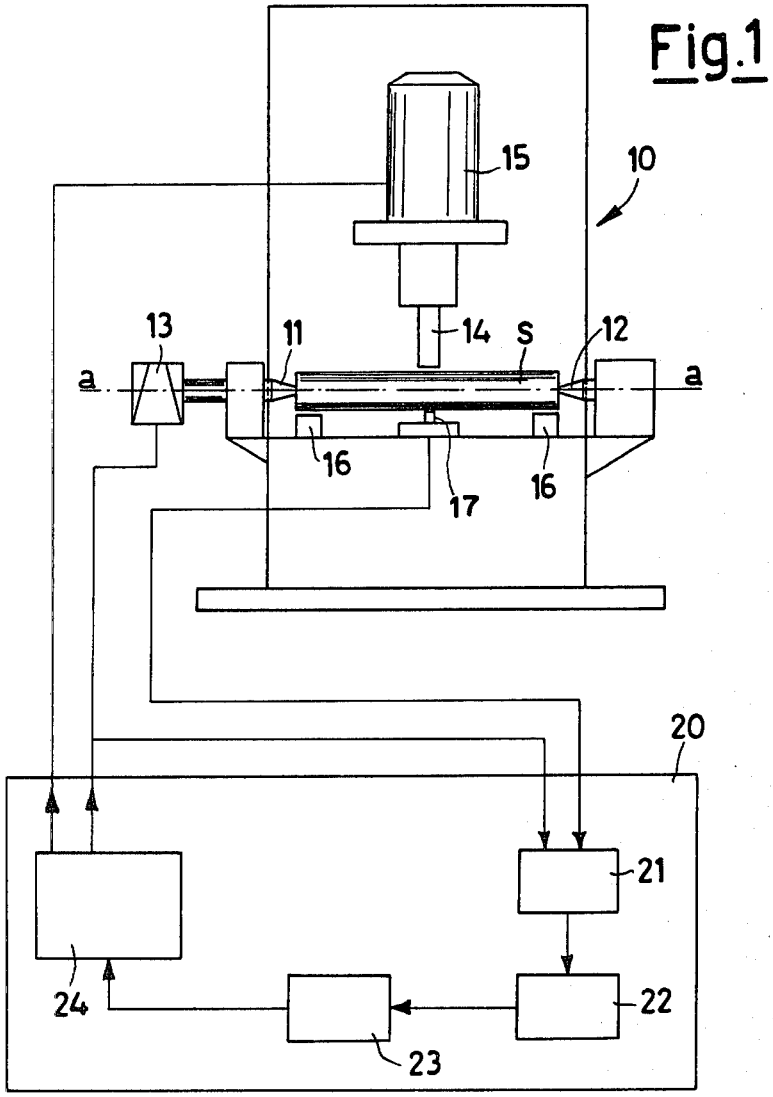

15
10
13
11
14
S
12
a
a
16
17
16
20
21
24
22
23

Ro+e
Ro
Ro-e
A
e
0
π/2
π
3/2 π
2 π

RM
0
φ
π/2
π
3/2 π
2 π

Ro
π/2
π
3/2 π
2 π

Ro
π/2
π
3/2 π
2 π

MACHINE FOR AUTOMATICALLY STRAIGHTENING-OUT ELONGATE WORKPIECES

Machines are known for automatically straightening-out elongate workpieces, that is, pieces having a predominantly longitudinal development and a circular cross-sectional outline.

Such machines provide for having the piece rotated between two end supporting members and for feeling at least at one point the magnitude of cyclical deviation of the felt profile from the theoretical value which would be expected if the cross-section concerned of the workpiece were exactly centred relative to the axis of rotation of such a piece.

Thus, in practice, on considering the outline of the workpiece exactly circular in correspondence with the circumferential zone on which it rests, the apparent radius of the piece, as felt by the sensor, will be exactly constant if the cross-section is exactly centred, whereas the apparent radius will vary harmonically because the off-centre section will actually behave like a crank end with a crank radius equal to the eccentricity due to the deviation of the axis of the piece from the true linearity.

It is understood herein that the apparent radius is the distance between the point of the workpiece on which the sensor is resting, from the axis defined by the two end supporting members. In practice, of course, the sensor might indicate a magnitude equal to the apparent radius, less any constant, that is, stated another way, the distance between the felt point of the workpiece and any fixed axis which has been selected beforehand.

The automatic straightening machines use the signal delivered by the sensor to position the workpiece in its angular position which corresponds to the alignment of the zone exhibiting the longest apparent radius with a straightening punch adapted to impress onto the piece one or more straightening strokes.

The maximum apparent radius, apparently, coincides, in theory, with the convexity of the workpiece.

The intensity of the straightening punch strokes is then automatically adjusted as a function of the difference between the maximum and the minimum apparent radius felt by the sensor, which corresponds to twice the eccentricity of the cross-section of the workpiece.

All the foregoing considerations, as outlined above, hold good if the workpiece has a perfectly circular cross-sectional outline, or if the deviation of the cross-sectional outline from the circumference has a magnitude which is negligible relative to the magnitude of the eccentricity of the cross-section which must be straightened-out by correction.

In the practice, conversely, it occurs that this condition is not fulfilled at all: the cross-sectional outline of the workpiece may have various kinds of irregularity such as ovality, triangularity or localized peaks. Each of these irregularities, apparently, influences the sensor which insists against the periphery of the workpiece, so that the correction of the eccentricity may become unreliable. As a matter of fact, the law of variation of the apparent diameter felt by the sensor may lose its theoretical correspondence with the curvature trend. To indicate a case of greatest simplicity, a localized peak (that is, a localized increase of the actual diameter of the workpiece) causes, on a radial sensor, the same effect of an eccentricity of the cross-section, and the automatic machine may thus be commanded to radially strike with the punch the localized peak zone, by reading it out as it were a point of maximum convexity due to a deviation from the linearity of the axis of the workpiece. By so doing, one might even arrive at a deformation of a piece which has a correctly rectilinear axis.

The wide variability of the irregularities of the profile which may occur in a cross-section which is theoretically circular might lead to think of an impossibility of discriminating the sensor signals due to said anomalies from the signals which conversely due to an actual eccentricity of such a cross-section.

As a matter of fact, the conventional straightening machines of automatic type are generally driven by the signals delivered by sensors which rest on the workpiece radially, so that they assume that all the deviations of the apparent radius from the theoretical radius are originated from deviations of the workpiece axis from the linearity.

In the conventional machines, a certain improvement can be achieved by suppressing a few peaks of the signal by virtue of the adoption of analogic filtering networks which, at any rate and due to their intrinsic nature, does not afford a complete gating of the signals due to the eccentricity of the cross-sections or to irregularities of the shape.

This invention has as its object to do away with the shortcomings of the prior art and, more particularly, to make it possible to provide an automatic straightening machine which enters action with a mechanical deformation of the piece in order to straighten it out without being influenced in a determining way by deviations of the cross-sectional outlines of the piece from the true circular shape.

In order that this object may be achieved, a straightening machine according to this invention comprises a couple of supporting members which are adapted to support for rotation a piece about an axis passing through the centres of the end sections, motive means for rotating the piece between the supporting members, at least a sensor insisting against the periphery of the piece to deliver an electric signal which is a function of the apparent radius of the piece relative to the axis defined by the supporting members, processing means for said electric signals to convert said first periodic electric signal into a second electric signal the magnitude of which varies with a law corresponding to the first harmonic according to the development in Fourier's series of the first electrical signal, and with a frequency equal to the frequency of rotation of the piece, means for straightening the piece and adapted to act thereon in the sense of deforming same to minimize the amplitude of the second electric signal.

The essential features of the invention will be better understood by the ensuing description of a practical embodiment of the invention, illustrated hereinafter with reference to the accompanying drawings, wherein:

FIG. 1 shows a diagram of a straightening machine according to the invention, and FIGS. 2, 3, 4 and 5 show plots of data detected in the machine of FIG. 1.

In a straightening machine, generally indicated at 10, there are provided supporting members 11 and 12 in the form of confrontingly positioned head and tail stock between which the workpiece is rotated, as driven by a motor 13.

The piece S can be acted upon a punch 14 driven by an actuator 15. The reaction to the blow impressed by the punch is absorbed by supporting members 16 so as not to load too intensively the supporting members 11 and 12. A sensor 17 rests onto the surface of the piece and is thus adapted to deliver a signal which is a function of the distances from the axis a—a of the points of the pieces on which it insists in sequential order due to the effect of the rotation of the same piece.

The structure of the straightening machine is not described in detail herein since it is known as itself in the art, so that only the functional elements useful for a correct understanding and application of the invention will be mentioned herein.

The signals delivered by the sensor are processed at 20 and corresponding signals are delivered to drive the motor 13 to position the piece S with the convex face confronting the punch 14, and to command thereafter the actuator 15 to strike the piece S to annul the eccentricity of the cross-section concerned.

In order that the basic principle of the invention may be correctly understood, it is appropriate to examine which is the type of trend of the signal delivered by the sensor 17 as a function of the shape irregularity of the piece S.

Let it be assumed, for example, that the cross-section of the piece, at the periphery of which the sensor insists, has an eccentricity, e, relative to the theoretical axis a—a of the piece.

Figure 2:
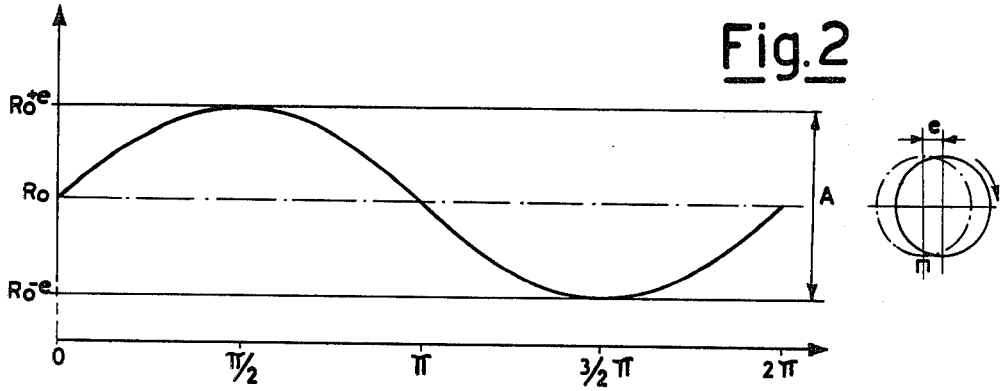

The signal delivered by the sensor will have a trend such as shown in FIG. 2, that is, a sinusoidal trend. In the plot, the abscissae indicate the angles of rotation of the piece, starting from a certain preselected reference position, and the ordinates indicate the apparent radii as detected by the sensor.

Apparently, the eccentricity of the cross-section will give in the plot a sinusoidal line having a period $P=2\pi$, and an amplitude $A=2e$, with an axis Ro which is the value that would have been detected by the sensor if the cross-section of the workpiece has been centred relative to the axis a—a.

Figure 3:
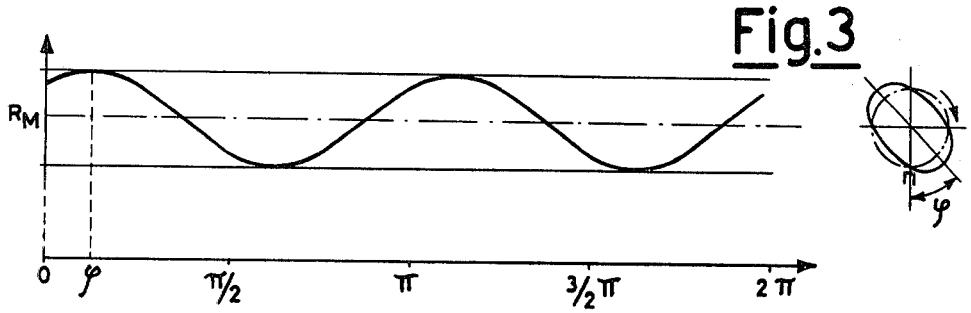

If the section, conversely, assuming that it be exactly centred, had a shape irregularity due to ovality, the detection by the sensor would be substantially the one indicated in FIG. 3, that is, a sinusoidal signal with a period, $P_2=\pi$, and an axis coinciding with a value of mean radius $R_M$.

Figure 4:
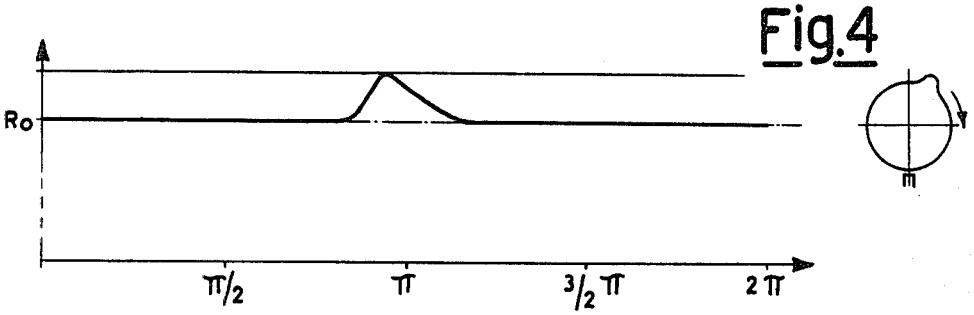

Lastly, for an irregularity of shape which is localized, that is a local peak, the detection would have the trend of the curve of FIG. 4, that is, a deviation from the value $R_o$ in correspondence with the passage of the peak before the sensor.

Other irregularities of shape will give other predictable plots. For example, a triangular deformation of the piece would give an oscillatory plot with a period of $\frac{2}{3}\pi$, and so forth.

Figure 5:
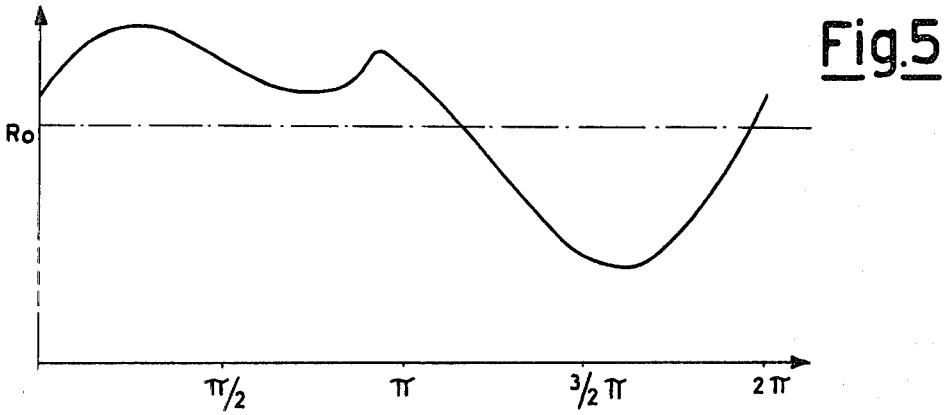

If a piece is considered, now, which combines the shape irregularities shown in FIGS. 2, 3 and 4, together, the sensor will detect, in substance, an apparent radius with a trend such as diagrammatical shown in FIG. 5. For the sake of simplicity, it has been assumed, substantially, $Ro=R_M$ so that the plot of FIG. 5 is the summation plot of the plots of FIGS. 2, 3 and 4.

As can be seen from the scrutiny of FIG. 5, the combination of different deformations and irregularities of the shape cause a variation both of the angular position of the maximum apparent radius on the basis of which the machine automatically preselects the position of action of the punch, and the amplitude of the deviation of the apparent radius from its theoretical value, on the basis of which the straightening machine automatically preselects the intensity of the blow impressed by the punch to the workpiece.

Inasmuch as the straightening machine can enter action only to correct the deformation of eccentricity of the cross-sections, it should be driven by a signal such as depicted in FIG. 2.

From well known mathematical principles, it stems that any general function, whenever it fulfils certain determined conditions, can be expressed as the summatory of a series of periodic functions: this transformation is known as a development in Fourier's series.

This invention is based on the observation that the eccentricity deformation of the cross-section of the work-piece involves a function with a period $2\pi$: thus, such a deformation will correspond to the first harmonic, having a just a period of $2\pi$, of a Fourier's series development of the function which is defined herein as the apparent radius of the workpiece.

The higher harmonics, that is, those having a period shorter than $2\pi$, are not concerned with deformations due to curvature of the piece, on which, only, the straightening machine can act.

According to the invention, in straightening machine of the kind indicated in FIG. 1, the circuit 20 will thus be equipped with a conventional block 21 for amplifying and demodulating the detection signal of the sensor 17 together with the angular position signal of the workpiece. The signal will be forwarded from 21 to the analogic-digital converter 22 and therefrom to the digital computer 23, in which the transformation (Fourier) calculations aforementioned are performed. Stated another way, the computer performs one of the known mathematical calculation runs which make it possible to obtain the coefficients of the first harmonic of the Fourier's series which approximates the function represented by the signal of the sensor 17, and more particularly, the maximum value of the first harmonic and the position of the maximum.

The computer thus gives the data of amplitude and position of the maximum of the first harmonic to the programmer 24 of the straightening procedure, which will operate in a manner known per se, for example as illustrated in the Italian Patent Specifications Nos. 775 201 and 929 256.

The programmer will compare the amplitude of the first harmonic with a tolerance value, and if such an amplitude exceeds the tolerance which is allowed, it will originate the correction of the piece, by rotating it until the point of the piece which corresponds to the maximum is brought in registry with the punch, and by programming the intensity of the blows or the series of blows to a magnitude which is sufficient to correct the deformation.

The foregoing description has been referred, for simplifying the disclosure, to a straightening machine operative in a single intermediate point of the workpiece.

It is apparent, however, that the operative principle of the invention can be adopted also in machines which effect the straightening by acting upon a number of points of the workpiece. That is, the machine can be provided with a plurality of sensors arranged longitudinally along the workpiece so as to bear against the workpiece at longitudinally spaced-apart locations, the signal of each sensor being fed to the processing system and the straightening means operating on the workpiece at longitudinally spaced-apart locations. The machine can also operate with any optional straightening programme, such as described, for example, in the U.S. Pat. No. 4,154,073 filed on May 15, 1979.

The straightening-out procedures mentioned above, in fact, operate with the assumption that the signal originated by the transductor which feels the diameter of the workpiece is influenced only by the longitudinal curvature of the piece and not by other irregularities of its shape, so that such procedures are impaired by considerable errors.

In addition, the invention provides to supply to the conventional straightening-out programmes a signal which is stripped of the principal irregularities of shape of the cross-section of the workpiece and thus provides, in practice, the hypothesis of geometrical circularity of the workpiece on which such programmes are based.

I claim:

1. A straightening machine for straightening longitudinal curvature of a workpiece by a bending action, comprising two supporting members adapted to support a workpiece for rotation, motive means for rotating the workpiece between said supporting members, a plurality of sensors bearing on the peripheral surface of the workpiece in longitudinally spaced-apart areas, each sensor being capable of generating a first periodic electric signal which is directly proportional to the apparent radius of the workpiece contour at the location of the respective sensor, whereby the signals are an indication of longitudinal curvature and of any deviation of the cross-sectional shape of the workpiece from a true circle, a Fourier processor receiving the periodic sensor signals and transforming them into second electric signals the magnitude of which varies with the law of variation corresponding to the first harmonic of the development in Fourier's series of the first signals, and with a frequency equal to the frequency of rotation of the workpiece, and means for straightening the workpiece to act at longitudinally spaced zones of said workpiece in the sense of deforming the workpiece to minimize the amplitude of the second electric signals.

2. A method of straightening longitudinal curvature of a workpiece by a bending action comprising supporting the workpiece between two supporting members, rotating the workpiece, engaging a plurality of sensors with the peripheral surface of the workpiece at longitudinally spaced-apart locations and generating with the sensors first periodic electric signals proportional to the apparent radius at the location of the sensors, whereby the signals are an indication of longitudinal curvature and of any deviation of the cross-sectional shape of the workpiece from a true circle, transforming the first signals into second electric signals the magnitude of which varies with the law of variation corresponding to the first harmonic of the development in Fourier's series of the first signals and the frequency of which equals the frequency of rotation of the workpiece, and applying bending forces to the workpiece in the sense of deforming the workpiece to minimize the amplitude of the second signals.

* * * * *